US010840623B2

(12) United States Patent
Nagasaka et al.

(10) Patent No.: US 10,840,623 B2
(45) Date of Patent: Nov. 17, 2020

(54) BOARD-MOUNTING CONNECTOR INCLUDING CYLINDRICAL PORTION HAVING SLIT WITH END PORTIONS OFFSET FROM ONE ANOTHER

(71) Applicant: Yazaki Corporation, Tokyo (JP)

(72) Inventors: Naokazu Nagasaka, Makinohara (JP); Shin Nemoto, Makinohara (JP); Koji Miyawaki, Makinohara (JP); Takashi Matsunaga, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 16/542,549

(22) Filed: Aug. 16, 2019

(65) Prior Publication Data

US 2020/0083624 A1 Mar. 12, 2020

(30) Foreign Application Priority Data

Sep. 11, 2018 (JP) ..... 2018-169815

(51) Int. Cl.

| | |
|---|---|
| ***H01R 12/72*** | (2011.01) |
| ***H01R 13/11*** | (2006.01) |
| *H01R 43/16* | (2006.01) |
| *H01R 12/57* | (2011.01) |

(52) U.S. Cl.

CPC ..... *H01R 12/721* (2013.01); *H01R 13/111* (2013.01); *H01R 12/57* (2013.01); *H01R 43/16* (2013.01)

(58) Field of Classification Search

CPC ..... H01R 13/111; H01R 43/16; H01R 12/57

See application file for complete search history.

(56) References Cited

U.S. PATENT DOCUMENTS

| | | | | |
|---|---|---|---|---|
| 2016/0315428 | A1 | 10/2016 | Kawakami et al. | |
| 2019/0131755 | A1 * | 5/2019 | Kerner | H01R 13/111 |

FOREIGN PATENT DOCUMENTS

| | | | | |
|---|---|---|---|---|
| CN | 106067617 | A | 11/2016 | |
| DE | 102016108254 | A1 * | 11/2017 | H01R 13/111 |
| JP | H07-326436 | A | 12/1995 | |
| JP | 2000-012165 | A | 1/2000 | |
| JP | 2012-038713 | A | 2/2012 | |
| JP | 5729165 | B2 | 6/2015 | |

* cited by examiner

*Primary Examiner* — Tho D Ta

(74) *Attorney, Agent, or Firm* — Banner & Witcoff, Ltd.

(57) ABSTRACT

A board-mounting connector includes a cylindrical terminal and a housing holding the cylindrical terminal. The cylindrical terminal includes a cylindrical portion in contact with a mating terminal, a contact portion extending in a direction intersecting a fitting direction so as to be connected to a circuit board, and an intermediate portion supported by the housing between the cylindrical portion and the contact portion. The cylindrical portion includes a slit defined, by bending a plate-shaped conductor into a cylindrical shape and abutting one edge portion thereof against another edge portion thereof, between the one edge portion and the other edge portion. Further, the slit is formed such that a slit tip end portion located on a mating terminal side of the cylindrical portion and a slit base end portion located on an intermediate portion side thereof are located at offset positions in a peripheral direction of the cylindrical portion.

4 Claims, 6 Drawing Sheets

BOARD-MOUNTING CONNECTOR INCLUDING CYLINDRICAL PORTION HAVING SLIT WITH END PORTIONS OFFSET FROM ONE ANOTHER

CROSS-REFERENCE TO RELATED APPLICATIONS

This application is based on and claims priority under 35 USC 119 from Japanese Patent Application No. 2018-169815 filed on Sep. 11, 2018, the contents of which are incorporated herein by reference.

TECHNICAL FIELD

The present invention relates to a board-mounting connector.

BACKGROUND ART

A board-mounting connector, in which a terminal including a contact portion soldered to a circuit board is held by a housing, is proposed in related arts. For example, in one board-mounting connector according to related arts, a through hole is provided on a wall surface of a housing, and a cylindrical-shaped terminal is inserted into the through hole and is held (see Patent Documents 1 and 2). In general, this type of cylindrical terminal is manufactured by bending a metal thin plate into a cylindrical shape, and includes a slit, formed by abutting one edge portion of the metal thin plate against another edge portion thereof, defined between these edge portions.

CITATION LIST

Patent Literature

Patent Document 1: Japanese Patent No. 5729165
Patent Document 2: JP-A-2000-012165

SUMMARY OF INVENTION

In the above-described board-mounting connector according to related arts, an intermediate portion of the cylindrical terminal, which is located between the cylindrical portion to which a mating terminal is connected and the contact portion connected to the circuit board, is held in the through hole of the housing. When the mating terminal is inserted into a cylinder of the cylindrical portion, the mating terminal abuts against an inner peripheral surface of the cylindrical portion, so that the cylindrical portion receives an external force from the mating terminal. At this time, inclination of the cylindrical portion (displacement in a direction intersecting an insertion direction) or the like does not occur if the inner peripheral surface of the cylindrical portion receives the external force uniformly. However, when the external force received by the inner peripheral surface of the cylindrical portion is biased, the cylindrical portion may be inclined, and the entire terminal may be displaced and rotate about the intermediate portion. Depending on a direction of the displacement of the entire terminal, the contact portion may be displaced and peeled off from the circuit board. From a viewpoint of maintaining reliability of electrical connection between the terminal and the circuit board, it is desirable that such displacement of the contact portion is inhibited as much as possible.

The present invention is made in view of the above circumstance, and an object of the present invention is to provide a board-mounting connector capable of improving the reliability of the electrical connection between the cylindrical terminal and the circuit board.

In order to achieve the above object, the board-mounting connector according to the present invention is characterized by the following [1] to [3].

[1]

A board-mounting connector, including: a cylindrical terminal electrically connected to a cylindrical mating terminal; and a housing configured to hold the cylindrical terminal.

The cylindrical terminal includes: a cylindrical portion extending along a fitting direction of the cylindrical terminal and the mating terminal, the cylindrical portion being in contact with the mating terminal; a contact portion extending in a direction intersecting the fitting direction so as to be connected to the circuit board; and an intermediate portion supported by the housing between the cylindrical portion and the contact portion.

The cylindrical portion includes a slit defined, by bending a plate-shaped conductor into a cylindrical shape and abutting one edge portion thereof against another edge portion thereof, between the one edge portion and the other edge portion, the slit being located on a lower side being a side facing the circuit board in a peripheral wall of the cylindrical portion.

The slit includes a slit tip end portion arranged on a mating terminal side of the cylindrical portion and a slit base end portion arranged on an intermediate portion side of the cylindrical portion.

The slit tip end portion and the slit base end portion are located at offset positions in a peripheral direction of the cylindrical portion.

[2]

In the board-mounting connector according to [1], the cylindrical portion is formed such that the slit base end portion is located in the peripheral wall of the cylindrical portion at a lowermost position, and the slit tip end portion is located at an offset position with respect to the slit base end portion in the peripheral direction.

[3]

In the board-mounting connector according to [2], the cylindrical portion is formed such that a slit intermediate portion, located between the slit tip end portion and the slit base end portion, is located at a position away from the slit base end portion in the same direction as the slit tip end portion in the peripheral direction.

[4]

In the board-mounting connector according to [3], the slit intermediate portion is located at a position father away from the slit base end portion than the slit tip end portion in the peripheral direction of the cylindrical portion.

With respect to the board-mounting connector having configuration [1], according to experiments and considerations made by the inventors, it is clear that when the cylindrical terminal contacts the mating terminal (for example, when the mating terminal is inserted into a cylinder of the cylindrical terminal), the cylindrical portion receives an external force biased around a portion where the slit is provided, and the cylindrical portion is displaced and inclined due to the bias of the external force. Furthermore, it is also clear that if a straight line shaped slit is provided in the peripheral wall of the cylindrical portion on a side where the contact portion extends toward the circuit board (that is, circuit board side peripheral wall), the cylindrical portion may be inclined and approach the circuit board, the entire cylindrical terminal may rotate about the intermediate portion, and the contact portion may be displaced in a direction in which the contact portion is peeled off from the circuit board.

The cylindrical terminal provided in the board-mounting connector of the present configuration has a configuration in which the slit tip end portion and the slit base end portion are offset in the peripheral direction of the cylindrical portion. According to experiments conducted by the inventors, it is clear that a direction in which the external force biased at the cylindrical portion is generated (in other words, the direction in which the cylindrical portion is displaced and inclined) can be controlled in accordance with an aspect of the offset. Therefore, even in a case where the slit needs to be disposed in the peripheral wall of the cylindrical portion on the circuit board side for various reasons, the displacement of the contact portion in the direction in which the contact portion is peeled off from the circuit board can be inhibited by adjusting the aspect of the offset of the slit as compared to a case where the slit has a straight line shape (that is, when the slit tip end portion and the slit base end portion are located at the same position in the peripheral direction). In this way, in the board-mounting connector of the present configuration, the cylindrical portion of the cylindrical terminal can arbitrarily control the bias of the external force received from the mating terminal, so that the reliability of the electrical connection between the cylindrical terminal and the circuit board can be improved.

With respect to the board-mounting connector having configuration [2], according to the experiments conducted by the inventors, it is clear that if a degree of the offset between the slit base end portion and the slit tip end portion is increased, the direction in which the external force biased at the cylindrical portion is generated can be separated from the direction in which the contact portion extends (that is, a direction of the circuit board side). As a result, the inclination of the cylindrical portion, toward the circuit board, can be reduced, and the displacement of the contact portion, in a direction away from the circuit board, can be reduced. Therefore, the board-mounting connector of the present configuration can improve the reliability of the electrical connection between the cylindrical terminal and the circuit board.

According to the board-mounting connector having the configuration [3], according to the experiments conducted by the inventors, it is clear that in a case where the slit intermediate portion is located at the position away from the slit base end portion in the same direction as the slit tip end portion in the peripheral direction, the direction in which the external force biased at the cylindrical portion is generated can be further separated from the direction in which the contact portion extends (that is, the direction of the circuit board side). Therefore, the board-mounting connector of the present configuration can further improve the reliability of the electrical connection between the cylindrical terminal and the circuit board.

According to the present invention, a board-mounting connector can be provided, which is capable of improving the reliability of the electrical connection between the cylindrical terminal and the circuit board.

The present invention is briefly described above. Details of the present invention will be further clarified by reading a mode for carrying out the present invention described below (hereinafter, referred to as "embodiment") with reference to the accompanying drawings.

DESCRIPTION OF EMBODIMENTS (Overall Configuration of Board-Mounting Connector)

Hereinafter, a board-mounting connector according to an embodiment of the present invention will be described with reference to the drawings. The board-mounting connector according to the embodiment of the present invention is a connector in which a terminal soldered to a circuit board 2 is held by a housing.

Figure 1:
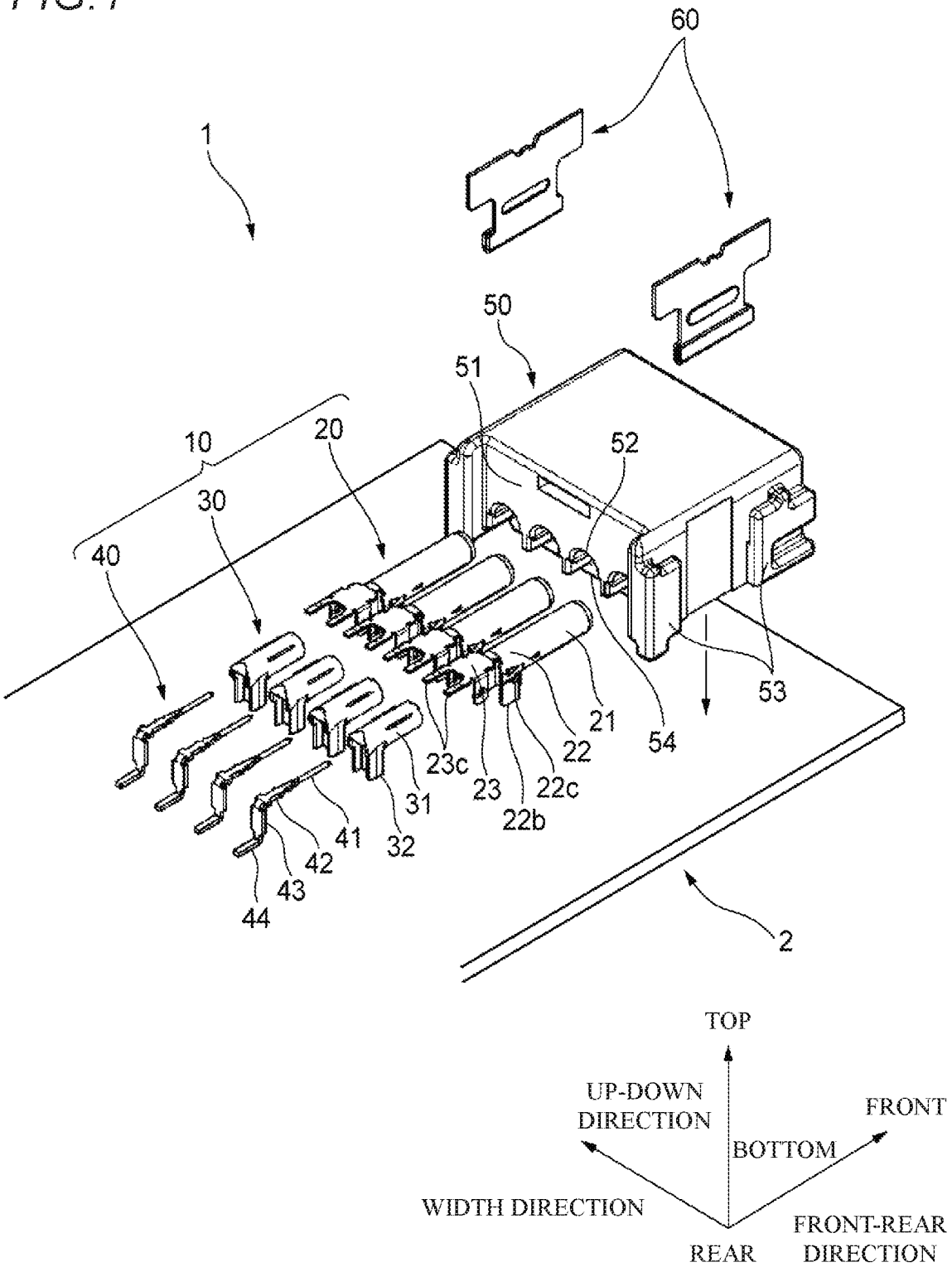
FIG. 1 is an exploded perspective view of a board-mounting connector according to the present embodiment.

As shown in FIG. 1, a board-mounting connector 1 according to the embodiment of the present invention includes a coaxial wire terminal unit 10 and a housing 50 for holding the terminal unit 10. For convenience of description, a front-rear direction, an up-down direction, a width direction, the front, the rear, the top, and the bottom are defined as shown in FIG. 1. The front-rear direction, the up-down direction, and the width direction are orthogonal to each other. The front-rear direction coincides with a fitting direction of the housing 50 and a mating housing, a fitting direction front side (a side close to a mating connector) corresponds to a front side, a fitting direction release side (a side away from the mating connector) corresponds to a rear side, and a side facing the circuit board 2 corresponds to a lower side. The front-rear direction also coincides with an insertion direction of the terminal unit 10 into the housing 50.

First, a configuration of the coaxial wire terminal unit 10 will be described. As shown in FIG. 1, the terminal unit 10 includes a metal cylindrical terminal (outer conductor terminal) 20, a dielectric 30 which is made of insulating synthetic resin and accommodated and held in the cylindrical terminal 20, and a metal inner conductor terminal 40 held by the dielectric 30.

The cylindrical terminal 20 is connected to a cylindrical mating outer conductor terminal (not shown) in a mating coaxial wire connected to the terminal unit 10, and has a function of grounding (earthing) the mating outer conductor terminal via the circuit board 2. The inner conductor terminal 40 is connected to a mating inner conductor terminal (not shown) in the mating coaxial wire, and has a function of transmitting a high frequency signal from the mating inner conductor terminal to the circuit board 2. The dielectric 30 has a function of maintaining the cylindrical terminal 20 and the inner conductor terminal 40 in an insulating state.

As shown in FIGS. 1, 2A, 2B and 4, the cylindrical terminal 20 integrally includes a cylindrical portion 21 which has a cylindrical shape, an intermediate portion 22 whose lower side is opened to form a hood shape, extending rearward from a rear end of the cylindrical portion 21, and a substantially rectangular flat plate-shaped lid portion 23 extending from a rear end of the intermediate portion 22.

Figure 2A:
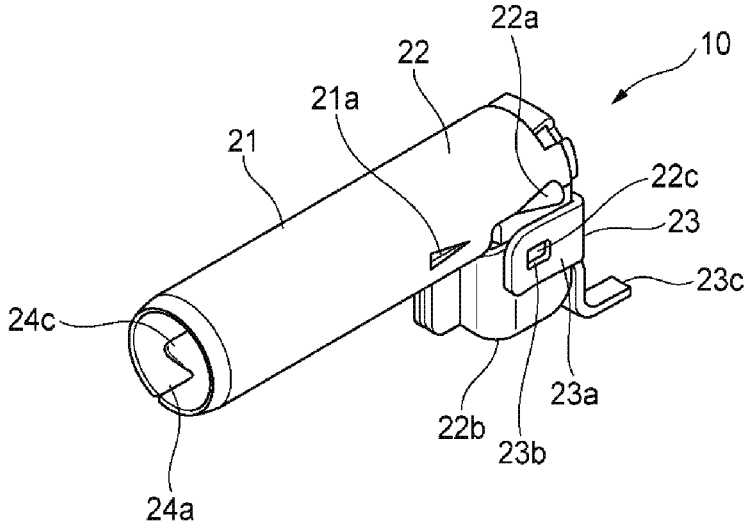
FIG. 2A is a perspective view of a terminal unit shown in FIG. 1.
Figure 2B:
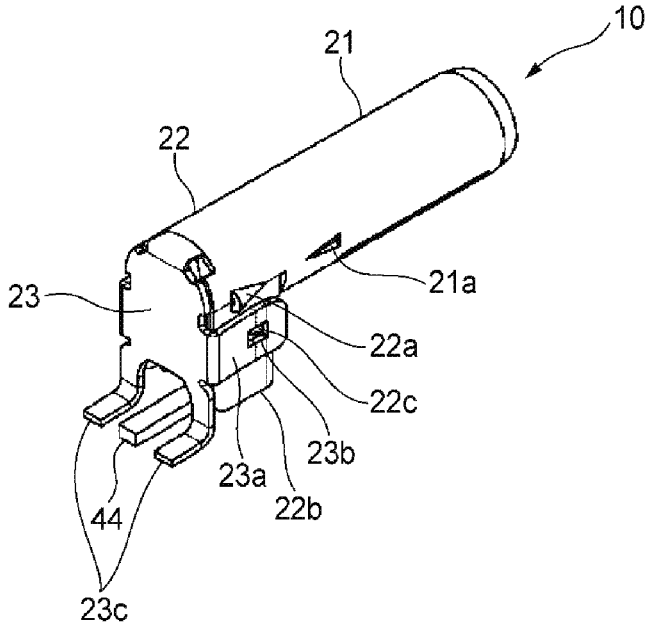
FIG. 2B is a perspective view of the terminal unit viewed from a different direction.

The cylindrical portion 21 has a function of inserting a cylindrical mating outer conductor terminal into a cylinder thereof and holding the cylindrical mating outer conductor terminal. As shown in FIGS. 2A and 2B, a press-fitting protrusion 21*a* protruding inward in the width direction is integrally provided on an inner surface of an end portion of the cylindrical portion 21 located on two width direction sides in the vicinity of a rear end portion of the cylindrical portion 21. The press-fitting protrusion 21*a* is provided to press-fit and fix the dielectric 30 (a cylindrical portion 31), which is inserted into the cylindrical portion 21, in the cylindrical portion 21. The cylindrical portion 21 is formed by bending a plate-shaped conductor into a cylindrical shape. Therefore, a linear slit 24 is formed in the cylindrical portion 21, the slit 24 being formed by abutting one edge portion against another edge portion in the peripheral direction (see FIG. 4). Details of the slit 24 will be described below.

The intermediate portion 22 has a function of fixing the cylindrical terminal 20 to the housing 50. Therefore, especially as shown in FIG. 2, a press-fitting projection 22*a* that protrudes outward in the width direction is provided on an outer surface of an end portion of the intermediate portion 22 located on two width direction sides. The press-fitting protrusion 22*a* press-fits and fixes the cylindrical terminal 20 (the terminal unit 10), which is inserted into a terminal accommodating hole 52 (described below) of the housing 50, in the terminal accommodating hole 52. Further, a stopper portion 22*b* protruding downward is integrally provided in the intermediate portion 22. The stopper portion 22*b* determines a position of the cylindrical terminal 20 (the terminal unit 10), which is inserted into the terminal accommodating hole 52, in the front-rear direction. Especially as shown in FIG. 1, a locking protrusion 22*c* protruding outward in the width direction is provided on two width direction side surfaces of the stopper portion 22*b*. The locking protrusion 22*c* locks the lid portion 23 bent downward.

As shown in FIGS. 2A to 4, the lid portion 23 is a portion hanging down from a rear end of the intermediate portion 22, and closes a rear end opening of the cylindrical terminal 20 (the intermediate portion 22) when a connecting portion of the lid portion 23 and the intermediate portion 22 is bent downward. The lid portion 23 has a function of preventing dust from entering from the rear end opening of the cylindrical terminal 20, and has a function of grounding (earthing) the cylindrical portion 21.

As shown in FIG. 2, in a hanging-down state, a pair of arm portions 23*a* extending forward from two width direction side edges of the lid portion 23 is provided in the lid portion 23. Each of the pair of arm portions 23*a* is formed with a locking hole 23*b* to be engaged with the locking protrusion 22*c* described above. In the hanging-down state, a pair of leg portions 23*c* extending downward from two width direction end portions of a lower end edge of the lid portion 23 is provided in the lid portion 23. The leg portion 23*c* is connected to a grounding portion (earthing portion) of the circuit board 2. The cylindrical portion 21 is electrically connected to the circuit board 2 through the lid portion 23 and the leg portion 23*c*. The lid portion 23 and the leg portion 23*c* as a whole correspond to the "contact portion" in the present invention.

As shown in FIG. 1, the dielectric 30 integrally includes the cylindrical portion 31 having a cylindrical shape, and a hanging-down portion 32 extending downward from a rear end portion of the cylindrical portion 31. When the dielectric 30 is assembled to the cylindrical terminal 20, in a state where the lid portion 23 extends rearward from the rear end of the intermediate portion 22 (a state shown in FIG. 1), the cylindrical portion 31 is inserted into the cylindrical portion 21 of the cylindrical terminal 20 from the rear side, until the hanging-down portion 32 abuts against a predetermined portion of the stopper portion 22*b* (see also FIG. 3B). At this time, the press-fitting protrusion 21*a* of the cylindrical portion 21 bites into an outer surface of the cylindrical portion 31, so that the cylindrical portion 31 (that is, the dielectric 30) is press-fitted and fixed to the cylindrical terminal 20.

As shown in FIG. 1, the inner conductor terminal 40 includes a connecting portion 41 extending in the front-rear direction, a press-fitting portion 42, which has a wide shape and is connected to a rear end portion of the connecting portion 41, a hanging-down portion 43 hanging down from a rear side of the press-fitting portion 42, and a leg portion 44 extending rearward from a lower end portion of the hanging-down portion 43. The leg portion 44 is connected to a portion that transmits a high-frequency signal in the circuit board 2.

Figure 3A:
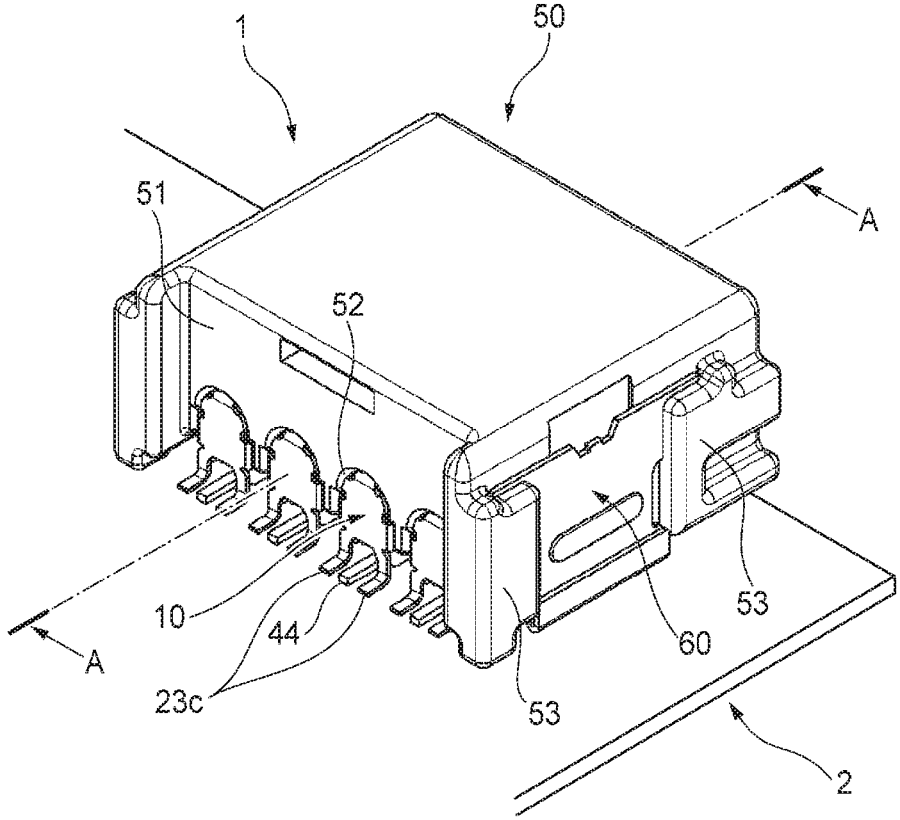
FIG. 3A is a perspective view of the board-mounting connector after assembly is completed.
Figure 3B:
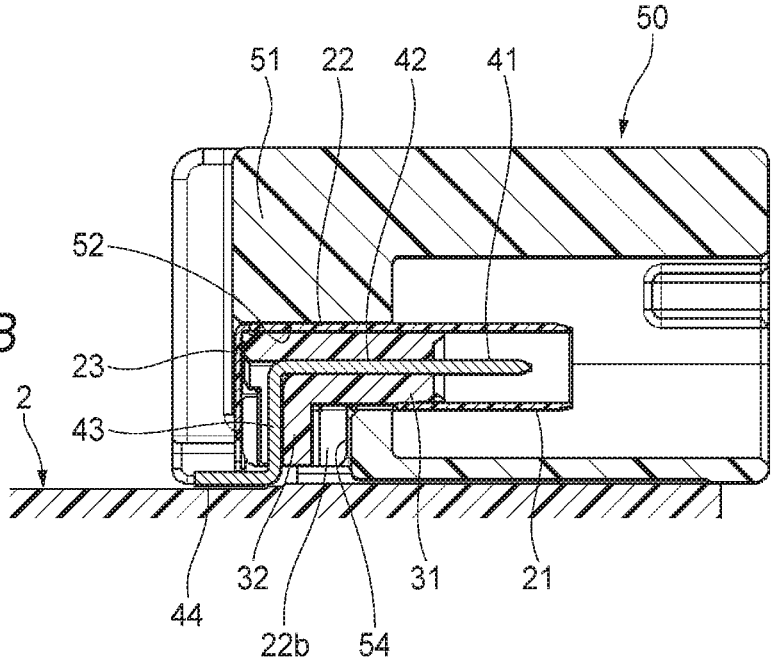
FIG. 3B is a cross-sectional view taken along line A-A of FIG. 3A.

When the inner conductor terminal 40 is assembled to the dielectric 30, the connecting portion 41 is inserted from the rear side into a through hole in the cylindrical portion 31 of the dielectric 30 until the hanging-down portion 43 abuts against a predetermined portion of the hanging-down portion 32 of the dielectric 30 (see also FIG. 3B). At this time, since the press-fitting portion 42 bites into an inner surface of the through hole of the cylindrical portion 31, the inner conductor terminal 40 is press-fitted and fixed to the dielectric 30. In this state, the connecting portion 41 of the inner conductor terminal 40 protrudes forward from a front surface of the cylindrical portion 31 and is exposed in the cylindrical portion 21 (see FIG. 3B). The connecting portion 41 is connected to the mating inner conductor terminal.

In this way, as shown in FIG. 2, in a state where the dielectric 30 is press-fitted and fixed to the cylindrical terminal 20 while the inner conductor terminal 40 is press-fitted and fixed to the dielectric 30, the pair of arm portions 23*a* is positioned outside two width direction side surfaces of the stopper portion 22*b*, and the connecting portion of the lid portion 23 and the intermediate portion 22 is bent downward, so that the lid portion 23 hangs down from the rear end of the intermediate portion 22. At this time, the locking hole 23*b* provided in the arm portion 23*a* is engaged with the locking protrusion 22*c* provided in the stopper portion 22*b*, so as to prevent the lid portion 23 from opening rearward.

Further, by bending middle portions of the pair of leg portions 23*c* extending downward from the hanging-down lid portion 23 rearward, tip end portions of the pair of leg portions 23*c* are made to extend rearward. Accordingly, the terminal unit 10, whose assembly is completed, is obtained as shown in FIG. 2. In this state, one flat plane (coplanar) is configured by lower surfaces of the pair of leg portions 23*c* extending rearward of the cylindrical terminal 20 and a lower surface of the leg portion 44 extending rearward of the inner conductor terminal 40. Accordingly, the pair of leg portions 23*c* and the leg portion 44 can be soldered to the plate-shaped circuit board 2. The terminal unit 10 is described above.

Next, the housing 50 will be described. As shown in FIGS. 1, 3A and 3B, the resin housing 50 is generally a rectangular parallelepiped box-like body having an internal space, whose front side is opened and rear side is closed by a rear end wall 51. The mating housing (not shown) including the mating connector is inserted and fitted into the housing 50 from a front opening of the housing 50.

A plurality of terminal accommodating holes 52 for holding a plurality of (in this example, four) terminal units 10 (more specifically, cylindrical terminals 20) are disposed at intervals in the width direction in a lower region of the rear end wall 51 so as to penetrate the plate-shaped rear end wall 51 of the housing 50 in the front-rear direction. A peg fixing portion 53 for fixing a pair of pegs 60 is provided on each of two width direction side surfaces of the housing 50.

When the terminal unit 10 is assembled to the terminal accommodating hole 52 of the housing 50, the terminal unit 10 (more specifically, the cylindrical terminal 20) is inserted from the rear side into the terminal accommodating hole 52 until the stopper portion 22*b* abuts against a lower end edge 54 located on a rear end side of the terminal accommodating hole 52 (see also FIG. 3B). At this time, the press-fitting protrusion 22*a* of the intermediate portion 22 bites into an inner surface of the terminal accommodating hole 52, so that the cylindrical terminal 20 (that is, the terminal unit 10) is press-fitted and fixed to the terminal accommodating hole 52.

In this state, a front side portion of the cylindrical terminal 20 protrudes forward from a front surface of the rear end wall 51 of the housing 50 and is exposed in the internal space of the housing 50 (see FIG. 3B). The cylindrical terminal 20 is connected to the mating outer conductor terminal. In this state, as shown in FIG. 3 (especially, FIG. 3B), one flat plane is configured by the one flat plane (coplanar) configured by the lower surfaces of the pair of leg portions 23*c* extending rearward of the cylindrical terminal 20 and the lower surface of the leg portion 44 extending rearward of the inner conductor terminal 40, and a planar-shaped lower surface (bottom surface) of the housing 50.

In this way, when the housing 50, to which the terminal unit 10 is press-fitted and fixed, is fixed to the circuit board 2, as shown in FIG. 3, the pegs 60 are fixed to the pair of peg fixing portions 53, and a pair of pegs 60 fixed to the peg fixing portions 53 is fixed to the circuit board 2. Accordingly, the housing 50 is mounted on the circuit board 2 via the pair of pegs 60. In this state, the pair of leg portions 23*c* and the leg portion 44 are soldered to the circuit board 2 by reflow type soldering. Accordingly, the board-mounting connector 1 mounted on the circuit board 2 is completed as shown in FIG. 3.

(Configuration of Slit and Function and Effect)

Hereinafter, the slit 24 in the cylindrical terminal 20 will be described with reference to FIGS. 4 and 5. As described above, since the cylindrical portion 21 of the cylindrical terminal 20 is formed by bending the plate-shaped conductor into the cylindrical shape, the linear slit 24 formed by abutting the one edge portion against the other edge portion in the peripheral direction is continuously formed from a front end of the cylindrical portion 21 to a rear end of the cylindrical portion 21. In this example, the slit 24 is positioned on a lower side (that is, a side where the lid portion 23 and the leg portion 23*c* extend toward the circuit board 2, the side facing the circuit board 2) of the cylindrical portion 21 (see also FIG. 2A).

As described above, in the board-mounting connector 1 according to the present embodiment, the cylindrical terminal 20 is held in the terminal accommodating hole 52 of the housing 50 in the intermediate portion 22. Therefore, when the mating outer conductor terminal is inserted into the cylinder of the cylindrical portion 21 of the cylindrical terminal 20, an inner peripheral surface of the cylindrical portion 21 receives an external force from the mating outer conductor terminal. At this time, the inner peripheral surface of the cylindrical portion 21 may not receive the external force uniformly, and the external force may be biased. As a result of this bias, when a large external force is applied to the lower side of the cylindrical portion 21 (that is, the side where the lid portion 23 and the leg portion 23*c* extend toward the circuit board 2 as a whole, the side facing the circuit board 2), the cylindrical terminal 20 is inclined and rotates about the intermediate portion 22 held by the housing 50, and the leg portion 23*c* and the leg portion 44 may be displaced in a direction away from the circuit board 2.

When the leg portion 23*c* and the leg portion 44 are displaced in the direction away from the circuit board 2 in this way, there is a possibility that proper connection is not maintained between the leg portion 23*c*, the leg portion 44, and the circuit board 2. Therefore, in view of maintaining reliability of electrical connection between the cylindrical terminal 20 and the circuit board 2, it is desirable to inhibit such displacement as much as possible.

Figure 4:
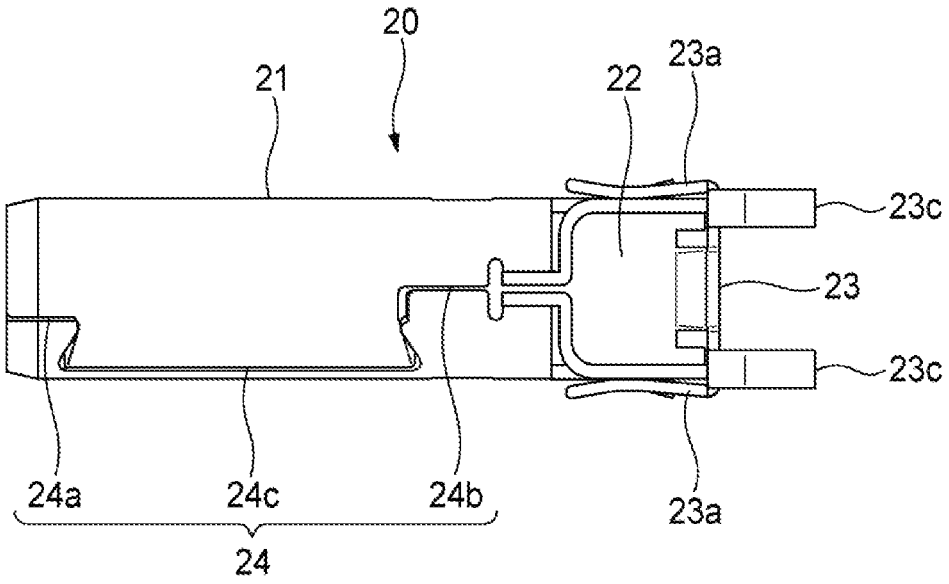
FIG. 4 is a bottom view of a cylindrical terminal shown in FIG. 1.

Therefore, in the board-mounting connector 1 according to the present embodiment, as shown in FIG. 4, the slit 24 continuous from the front end to the rear end of the cylindrical portion 21 is configured such that a slit tip end portion 24*a* located on the front side (mating terminal side) and a slit base end portion 24*b* located on the rear side (intermediate portion 22 side) are located at offset positions in the peripheral direction of the cylindrical portion 21. More specifically, the slit base end portion 24*b* is located in the peripheral wall of the cylindrical portion 21 at a position located on an utmost extending side of the leg portions 23*c*, 44 (that is, a lowermost position), and the slit tip end portion 24*a* is located at an offset position with respect to the slit base end portion 24*b* in the peripheral direction of the cylindrical portion 21. Further, a slit intermediate portion 24*c*, located between the slit tip end portion 24*a* and the slit base end portion 24*b*, is located at a position farther away from the slit base end portion 24*b* than the slit tip end portion 24*a* in the peripheral direction of the cylindrical portion 21.

According to experiments and considerations made by the inventors, it is clear that when the mating outer conductor terminal abuts against the cylinder of the cylindrical terminal 20, the cylindrical portion 21 receives an external force biased around a portion where the slit 24 is provided, and the cylindrical portion 21 is displaced to be inclined corresponding to the bias of the external force (in other words, a direction of a maximum stress generated in the cylindrical portion 21).

Figure 5A:
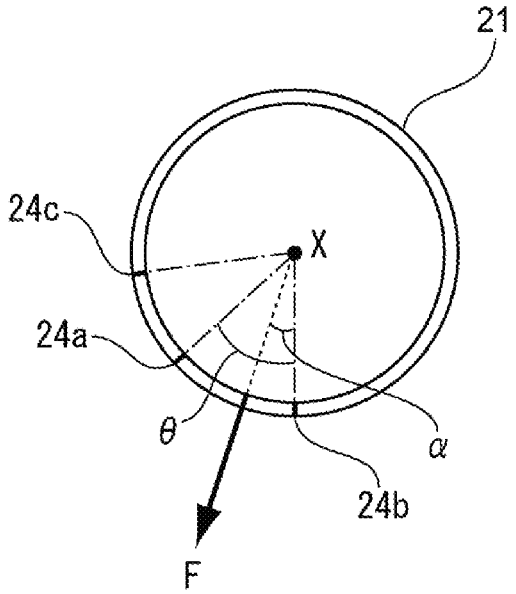
FIG. 5A schematically shows a position of a slit when the cylindrical terminal shown in FIG. 4 is viewed from a front side.
Figure 5B:
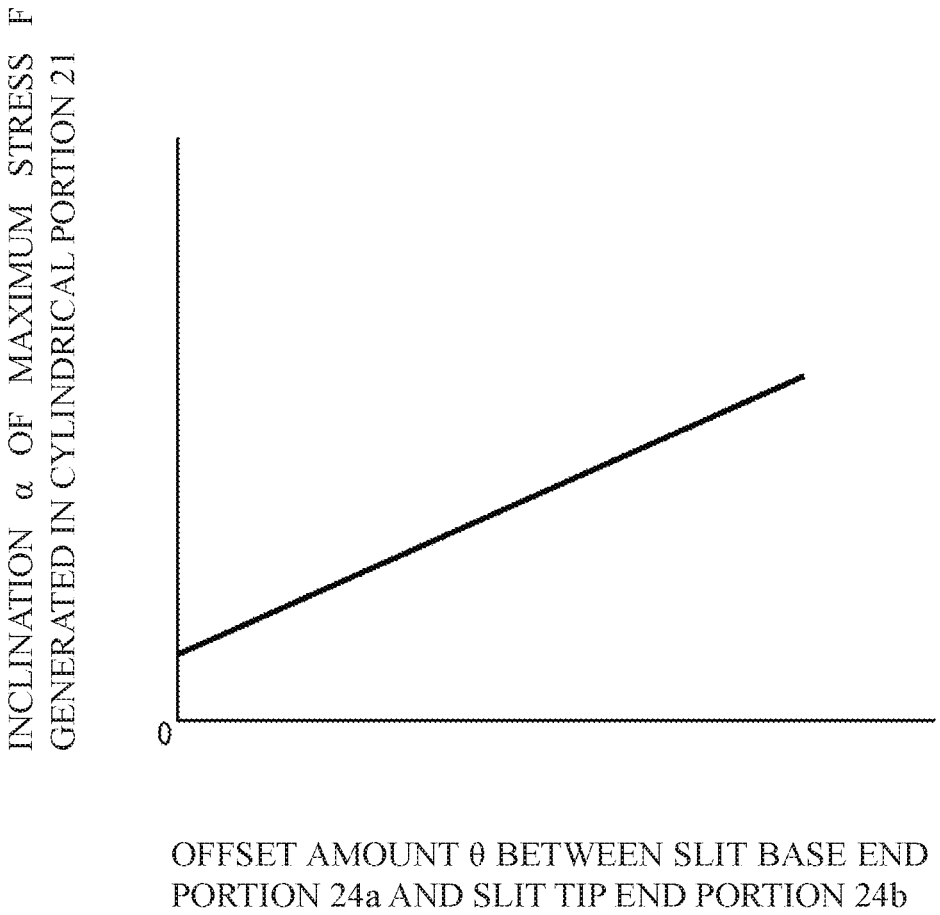
FIG. 5B is a graph schematically showing a relationship between a direction of a maximum stress generated in a cylindrical portion and an offset amount between a slit base end portion and a slit tip end portion in the cylindrical terminal shown in FIG. 4.

More specifically, as shown in FIG. 5A, an angle formed by a line segment connecting a center X of the cylindrical portion 21 and the slit tip end portion 24*a* and a line segment connecting the center X and the slit base end portion 24*b* when the cylindrical portion 21 is viewed from the front (mating terminal side) is defined as an offset amount θ. An angle formed by the line segment connecting the center X and the slit base end portion 24*b* and a line segment connecting the center X and a position where a maximum stress F is generated in the cylindrical portion 21 is defined as an inclination α of the maximum stress F. According to the experiments conducted by the inventors, as shown in FIG. 5B, it is clear that the inclination α increases as the offset amount θ increases. In other words, it is clear that the inclination α can be controlled by adjusting the offset amount θ. It is also clear that even when the offset amount θ is zero, the inclination α is generated corresponding to the slit intermediate portion 24*c*.

Therefore, even in a case where the slit 24 needs to be disposed in the peripheral wall of the cylindrical portion 21 on the circuit board side for various reasons, the displacement of the leg portions 23*c*, 44 in the direction in which the leg portions 23*c*, 44 are peeled off from the circuit board 2 can be inhibited by adjusting an aspect of the offset (for example, the offset amount θ) of the slit 24 as compared to a case where the slit has a straight line shape (that is, when the slit tip end portion 24*a* and the slit base end portion 24*b* are located at the same position in the peripheral direction). In this way, in the board-mounting connector 1, the cylindrical portion 21 of the cylindrical terminal 20 can arbitrarily control the bias (the inclination α of the maximum stress F) of the external force received from the mating terminal, so that the reliability of the electrical connection between the cylindrical terminal 20 and the circuit board 2 can be improved.

Further, as understood from the fact that the inclination α is generated even when the offset amount θ is zero, in a case where the slit intermediate portion 24*c* is located at the position away from the slit base end portion 24*b* in the same direction as the slit tip end portion 24*a* in the peripheral direction, the direction (inclination α of the maximum stress F) in which the external force biased at the cylindrical portion 21 is generated can be further separated from the direction in which the leg portions 23*c*, 44 extend (that is, the direction of the circuit board 2 side). Accordingly, the reliability of the electrical connection between the cylindrical terminal 20 and the circuit board 2 can be further improved.

Other Embodiments

The present invention is not limited to the above embodiment, and various modifications can be made within the scope of the present invention. For example, the present invention is not limited to the embodiment described above, and modifications, improvements, and the like can be made as appropriate. In addition, the material, shape, size, number, arrangement position, and the like of each component in the above-described embodiments are optional and are not limited as long as the present invention can be achieved.

Figure 6A:
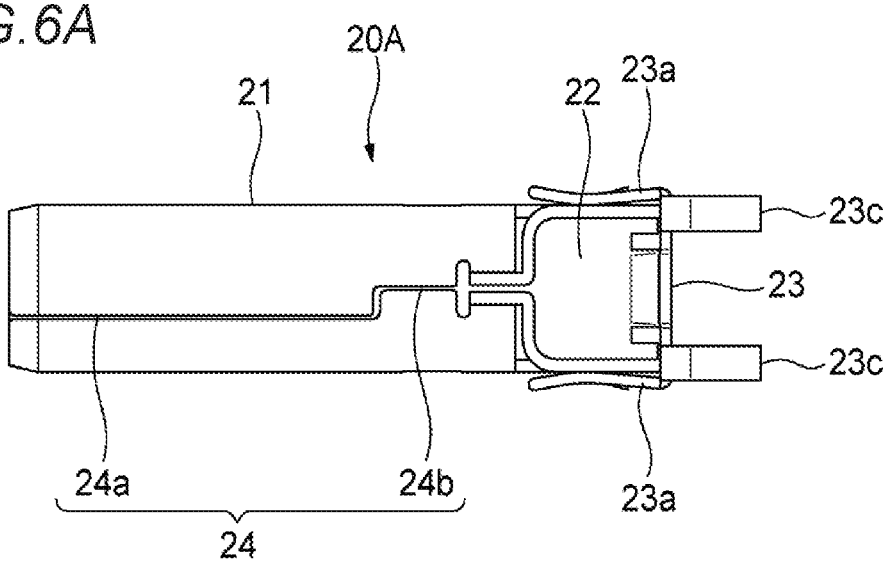
FIG. 6A is a bottom view of a cylindrical terminal according to a modification.
Figure 6B:
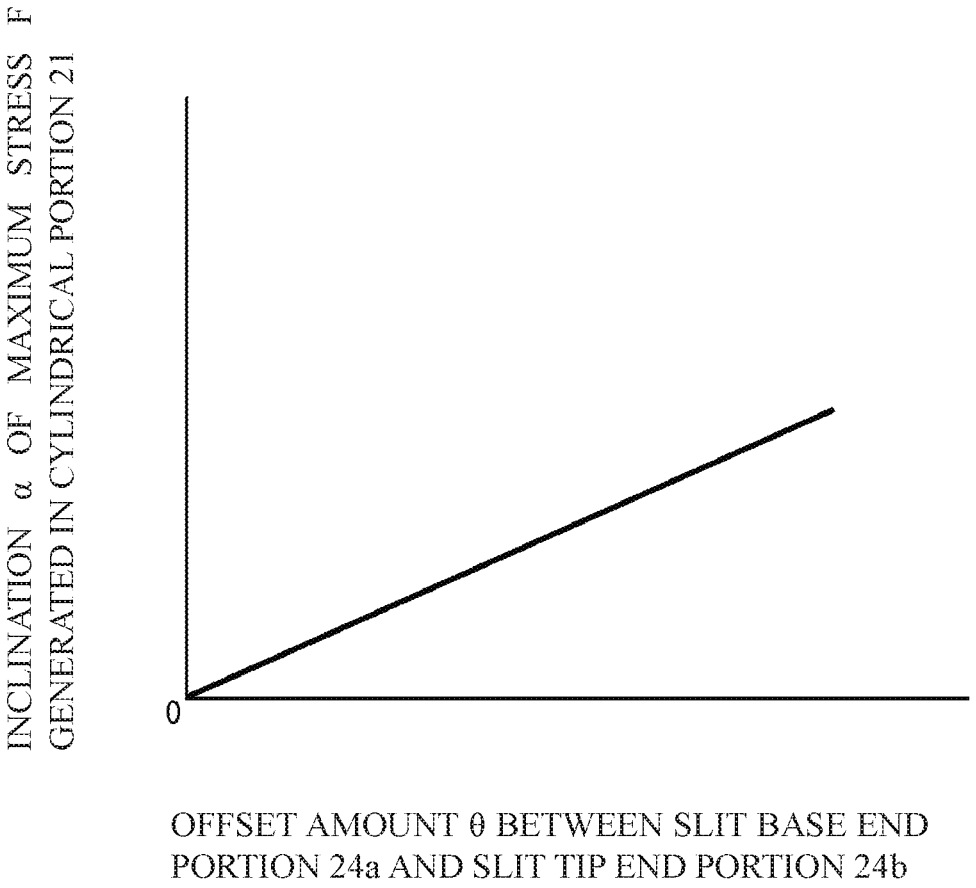
FIG. 6B is a graph corresponding to FIG. 5B in the cylindrical terminal shown in FIG. 6A.

In the above embodiment, as shown in FIG. 4, the slit 24 of the cylindrical portion 21 includes the slit tip end portion 24*a*, the slit base end portion 24*b*, and the slit intermediate portion 24*c* which are offset with respect to each other in the peripheral direction. In contrast, as in the cylindrical terminal 20A shown in FIG. 6A, the slit intermediate portion 24*c* may be omitted, and the slit tip end portion 24*a* may be extended to the rear side to replace the slit intermediate portion 24*c*. Also in this case, according to the experiments conducted by the inventors, as shown in FIG. 6B, it is clear that the inclination α increases as the offset amount θ increases. This point is the same as the cylindrical terminal 20 shown in FIG. 4. When the slit intermediate portion 24*c* is omitted as in the cylindrical terminal 20A, it is clear that the inclination α is zero if the offset amount θ is zero (that is, if the slit tip end portion 24*a* and the slit base end portion 24*b* are located at the same position in the peripheral direction).

Features of the embodiment of the board-mounting connector 1 according to the present invention are briefly summarized in the following [1] to [3].

[1]

A board-mounting connector (1), including: a cylindrical terminal (20) which is electrically connected to a circuit board (2) and electrically connected to a cylindrical mating terminal; and a housing (50) which holds the cylindrical terminal (20).

The cylindrical terminal (20) includes: a cylindrical portion (21) extending along a fitting direction of the cylindrical terminal (20) and the mating terminal, the cylindrical portion (21) being in contact with the mating terminal; a contact portion (23, 23*c*) extending in a direction intersecting the fitting direction so as to be connected to the circuit board (2); and an intermediate portion (22) supported by the housing (50) between the cylindrical portion (21) and the contact portion (23, 23*c*).

The cylindrical portion (21) includes a slit (24) defined, by bending a plate-shaped conductor into a cylindrical shape and abutting one edge portion thereof against another edge portion thereof, between the one edge portion and the other edge portion, the slit (24) being located on a lower side being a side facing the circuit board (2) in a peripheral wall of the cylindrical portion (21).

The slit (24) includes a slit tip end portion (24*a*) located on a mating terminal side of the cylindrical portion (21) and a slit base end portion (24*b*) located on an intermediate portion (22) side of the cylindrical portion (21).

The slit tip end portion (24*a*) and the slit base end portion (24*b*) are located at offset positions in a peripheral direction of the cylindrical portion (21).

[2]

In the board-mounting connector (1) according to [1], the cylindrical portion (21) is formed such that the slit base end portion (24*b*) is located in the peripheral wall of the cylindrical portion (21) at a lowermost position, and the slit tip end portion (24*a*) is located at an offset position with respect to the slit base end portion (24*b*) in the peripheral direction.

[3]

In the board-mounting connector (1) according to [2], the cylindrical portion (21) has a configuration in which a slit intermediate portion (24*c*), located between the slit tip end portion (24*a*) and the slit base end portion (24*b*), is located at a position away from the slit base end portion (24*b*) in the same direction as the slit tip end portion (24*a*) in the peripheral direction.

[4]

In the board-mounting connector (1) according to [3], the slit intermediate portion (24*c*) is located at a position father away from the slit base end portion (24*b*) than the slit tip end portion (24*a*) in the peripheral direction of the cylindrical portion (21).

What is claimed is:

1. A board-mounting connector comprising:

a cylindrical terminal which is electrically connected to a circuit board and electrically connected to a mating terminal; and a housing which holds the cylindrical terminal, wherein the cylindrical terminal includes:

a cylindrical portion which extends along a fitting direction of the cylindrical terminal and the mating terminal and is in contact with the mating terminal;

a contact portion extending in a direction intersecting the fitting direction so as to be connected to the circuit board; and an intermediate portion supported by the housing between the cylindrical portion and the contact portion, wherein the cylindrical portion includes:

a slit defined, by a plate-shaped conductor bent into a cylindrical shape and abutting one edge portion thereof against another edge portion thereof, between the one edge portion and the other edge portion, the slit being located on a lower side facing the circuit board in a peripheral wall of the cylindrical portion, wherein the slit includes a slit tip end portion arranged on a mating terminal side of the cylindrical portion and extending from one location of the one edge portion, and a slit base end portion arranged on an intermediate portion side of the cylindrical portion and extending from another location of the one edge portion, and the slit tip end portion and the slit base end portion are located at offset positions in a peripheral direction of the cylindrical portion.

2. The board-mounting connector according to claim 1, wherein the cylindrical portion is formed such that the slit base end portion is located in the peripheral wall of the cylindrical portion at a lowermost position, and the slit tip end portion is located at an offset position with respect to the slit base end portion in the peripheral direction.

3. The board-mounting connector according to claim 1, wherein the cylindrical portion is formed such that a slit intermediate portion, located between the slit tip end portion and the slit base end portion, is located at a position away from the slit base end portion in the same direction as the slit tip end portion in the peripheral direction.

4. The board-mounting connector according to claim 1, wherein the cylindrical portion is formed such that a slit intermediate portion, located between the slit tip end portion and the slit base end portion, is located at a position farther away from the slit base end portion than the slit tip end portion in the peripheral direction of the cylindrical portion.

* * * * *